US006845574B2

(12) United States Patent
Zanco

(10) Patent No.: US 6,845,574 B2
(45) Date of Patent: Jan. 25, 2005

(54) BOOT FOR SKI OR IN-LINE ROLLER SKATE

(75) Inventor: Alain Zanco, Voiron (FR)

(73) Assignee: Skis Rossignol S.A., Voiron (FR)

( * ) Notice: Subject to any disclaimer, the term of this patent is extended or adjusted under 35 U.S.C. 154(b) by 334 days.

(21) Appl. No.: 09/172,830

(22) Filed: Oct. 15, 1998

(65) Prior Publication Data

US 2001/0039748 A1 Nov. 15, 2001

(30) Foreign Application Priority Data

Oct. 17, 1997 (FR) ..... 97 13260

(51) Int. Cl.[7] ..... A43B 5/04

(52) U.S. Cl. ..... 36/102; 36/115; 36/117.3; 36/117.4

(58) Field of Search ..... 36/102, 115, 117.2, 36/117.3, 117.4; 280/616, 617, 614, 615, 625

(56) References Cited

U.S. PATENT DOCUMENTS

| | | | | | |
|---|---|---|---|---|---|
| 3,953,042 | A | * | 4/1976 | Pyzel et al. | 280/631 |
| 4,176,856 | A | * | 12/1979 | Glaser | 280/611 |
| 4,186,500 | A | * | 2/1980 | Salzman | |
| 4,246,708 | A | * | 1/1981 | Gladek | |
| 4,403,789 | A | * | 9/1983 | Hickey | 280/614 |
| 4,505,056 | A | * | 3/1985 | Beneteau | |
| 4,674,202 | A | * | 6/1987 | Bourque | |
| 4,677,769 | A | | 7/1987 | Ahmad et al. | |
| 4,839,972 | A | | 6/1989 | Pack et al. | |
| 4,982,515 | A | * | 1/1991 | Sartor | |
| 5,505,477 | A | * | 4/1996 | Turner | |
| 5,572,806 | A | | 11/1996 | Osawa | |
| 5,771,609 | A | | 6/1998 | Messmer | |
| 5,784,809 | A | * | 7/1998 | McDonald | |
| 5,815,952 | A | | 10/1998 | Bobrowicz | |
| 5,884,420 | A | * | 3/1999 | Donnadieu | |
| 5,899,006 | A | * | 5/1999 | Donnadieu | |
| 5,918,386 | A | * | 7/1999 | Marmonier | |
| 6,173,510 | B1 | * | 1/2001 | Zanco | 36/119.1 |

FOREIGN PATENT DOCUMENTS

| | | | |
|---|---|---|---|
| DE | 865 425 | | 10/1948 |
| DE | 865425 | * | 2/1953 |
| DE | 949336 | * | 9/1956 |
| DE | 2514207 | * | 10/1976 |
| DE | 25 14 207 | | 10/1976 |
| DE | 3405617 | | 8/1984 |
| EP | 0 753 267 | | 1/1997 |
| EP | 0 799 582 | | 10/1997 |
| FR | 2 130 644 | | 11/1972 |
| FR | 2 309 168 | | 11/1976 |
| WO | WO 97 09893 | | 3/1997 |

OTHER PUBLICATIONS

French Search Report dated Aug. 10, 1998 (Rapport De Recherche Preliminaire).

* cited by examiner

*Primary Examiner*—Ted Kavanaugh
(74) *Attorney, Agent, or Firm*—Frommer Lawrence & Haug LLP; Ronald R. Santucci

(57) ABSTRACT

A boot for a ski or an in-line roller skate has a flexible upper and a sole allowing the foot to flex during walking. Its sole has a rigid part in the rear region of the boot, over about one half of the length of the sole, this rigid part being designed so as to form an interface between the heel and a binding of the ski or in-line roller skate. The interface may be standard, that is to say independent of the boot size.

5 Claims, 4 Drawing Sheets

Fig.3
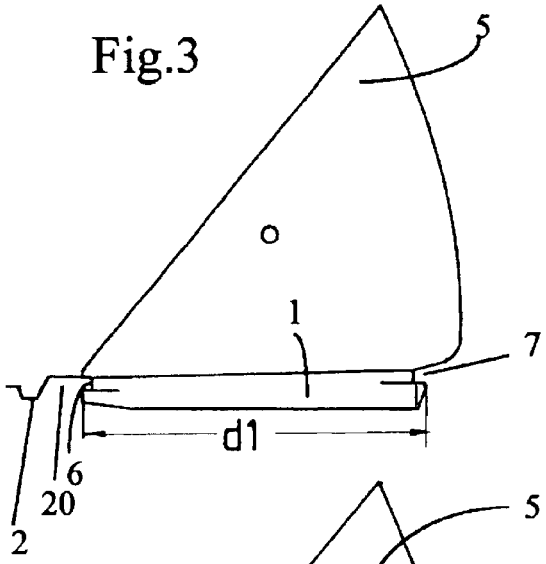
Fig.4
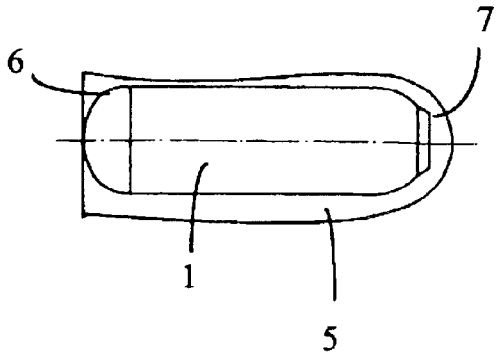
Fig.5
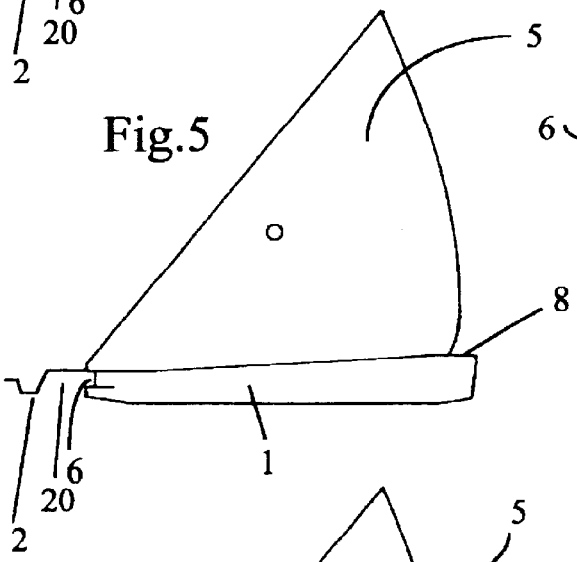
Fig.6
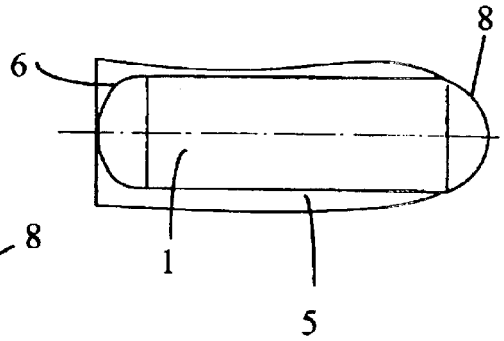
Fig.7
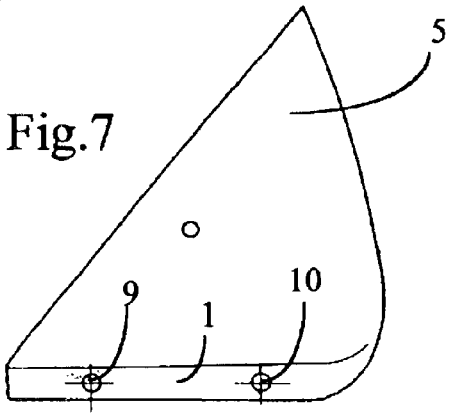
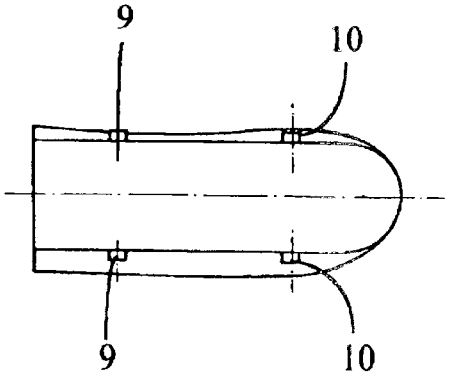
Fig.8

BOOT FOR SKI OR IN-LINE ROLLER SKATE

FIELD OF THE INVENTION

The invention relates to a boot for a ski or in-line roller skate, having a flexible upper, the sole of which has a rigid part in the rear region of the boot, over about one half of the length of the sole, and the rest of the sole of which is flexible so as to allow the foot to flex during walking.

PRIOR ART

When ski boots were made of leather, the sole still retained a degree of flexibility which made it possible to walk without excessive difficulty. With the arrival of plastic boots, the upper, and more particularly the sole, acquired rigidity which provided an excellent interface between the foot and the ski through the ski binding, but made it difficult to walk normally because the sole did not flex at all at the metatarsophalangeal joint. Together with the sport of snowboarding, with which much more walking is involved, relatively flexible boots appeared. In order for them to be fastened to the gliding board, some of these boots are provided with an attached metal plate. However, this plate tends to become packed with snow and catch on the ground during walking. It has also been proposed to fix a metal sheet in a longitudinal groove of the sole, between the metatarsophalangeal joint zone and the heel (EP 0 719 505). These plates and sheets represent no more than auxiliary binding means. Further, the problem of snowboarding is different than that of skiing since automatic binding release is not desired, the two feet being on the same board and the degree of risk being lower.

For a number of years, attempts have been made to make it easier to walk with alpine ski boots by using a variety of methods. Patent EP-0-664 969 proposes, in a plastic boot, to provide a flexible zone forming a hinge in the metatarsophalangeal zone of the rigid sole, and to divide the shell of the boot into two parts, articulated level with said joint, these two parts also being joined together by a device which allows the articulation to be locked.

A boot designed along the same principle is also disclosed by U.S. Pat. No. 5,572,806. This boot differs from the previous one by the fact that the locking device is mounted so that it can slide in the thickness of the sole.

Another approach is described in Patent FR 2 130 644. It consists of a kind of auxiliary shell in which a boot with flexible upper and sole is enclosed.

Moreover, Patent FR 2 309 168 discloses a ski touring boot whose rear part has a rigid sole, while its front part has a flexible sole. This boot is, however, intended to be fixed by its ends, so that the front end of its sole has a track which is intended to engage with a front binding element. A track of this type makes it difficult to walk.

Lastly, boots are known which are intended for cross country skiing. It is absolutely necessary for these boots to be flexible in the metatarsophalangeal zone, so as to allow the foot to roll with minimal resistance. When used for the freestyle skating step, this type of boot has needed to be reinforced in the malleolar zone, but these boots, for example the boot described in document FR 2 743 988, are still cross country ski boots that only have a front binding.

As regards in-line roller skates, a boot is known which is intended to be releasably fixed on a chassis. To this end, the flexible sole of the boot has two metal hooks which attach to the chassis.

SUMMARY OF THE INVENTION

The object of the present invention is to provide the user with a flexible and comfortable boot which, on the one hand, makes it possible to walk with ease and, on the other hand, forms an interface between the leg and the ski or the skate, this interface being capable of resisting the forces involved with the release of a ski binding or the engagement of the skate, respectively.

To this end, the boot according to the invention is one wherein the rigid part of the sole is designed so as to form an interface between the leg and the binding of a ski or in-line roller skate.

Since a ski is controlled substantially in extension of the tibia, a rigid interface in the region of the sole through which this extension passes is found to be quite sufficient. Further, it is known that a binding whose release axis coincides with the tibial axis has advantages in terms of safety. It is in this way possible to design the front end of the boot freely, and in particular to give it a rounded shape that makes it particularly easy to walk.

The upper of the boot preferably comprises a rigid part which encloses the heel and is rigidly secured to the rigid part of the sole. These rigid parts form the rear of the boot and, to some extent, represent what remains of the shell of a shell boot.

In its embodiment as an alpine ski boot, in particular, the rigid part enclosing the heel will advantageously be provided with a cuff articulated to this rigid part.

One current trend in the development of alpine skiing is toward a very short ski. On a ski of this type, if the intention is to retain the original flexibility of the ski, it is no longer possible to use conventional boots and binding assemblies, because the ski becomes rigid, and no longer has the facility to work and therefore execute turns. Precisely what the boot according to the invention makes it possible to do is to bring the heel piece and the toe piece of conventional binding assemblies closer together, or even eliminate them. The rigid part of the sole will be in the form of a profiled part of standard length, that is to say independent of the boot size.

The ski binding may be further shortened by providing some of the binding means in the rigid part of the sole of the boot. These binding means may be, for example, depending on the type of binding used, pins, a rail or a different profiled part.

The binding of the boot to the ski or to the skate may thus be located in extension of the tibial axis.

BRIEF DESCRIPTION OF THE DRAWINGS

The appended drawing represents a few embodiments of the boot according to the invention by way of example.

FIGS. 3 and 4 are, respectively, a side and bottom view of a first embodiment of the rigid part of a boot according to the invention.

FIGS. 5 and 6 are, respectively, a side and bottom view of a second embodiment of the rigid part.

FIGS. 7 and 8 are, respectively, a side and bottom view of a third embodiment of the rigid part.

DESCRIPTION OF THE PREFERRED EMBODIMENTS

Figure 1:
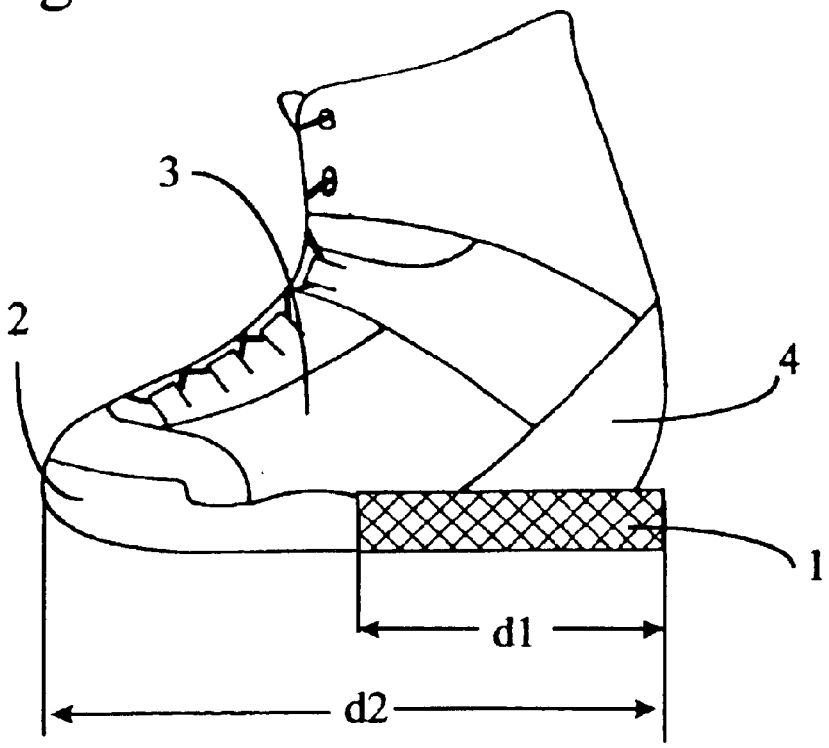
FIG. 1 illustrates the design principle of the boot according to the invention.

FIG. 1 represents an essentially flexible boot whose sole has a rigid part 1 extending from the heel toward the front over a length d1 equal to about one half of the total length of the boot d2. The rest 2 of the sole is advantageously formed by an elastomer which rises over the sides and the front of the upper to make the boot watertight. The rest 3 of the upper of the boot is made of flexible material, for example leather, flexible plastic or woven material, or a combination of these materials, reinforced at the rear of the heel region 4. The boot which is represented is provided with a lacing system, but tightening could be provided by any other means, in particular by buckles.

Figure 2:
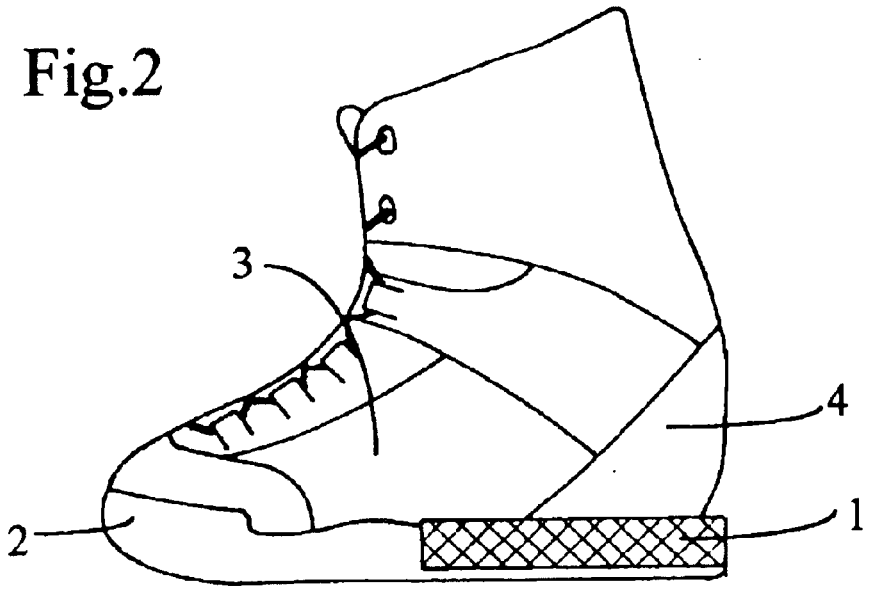
FIG. 2 represents an alternative embodiment of the boot represented in FIG. 1.

In the variant which is represented in FIG. 2, the material of the part 2 of the sole, for example an elastomer, extends in a thin layer under the rigid part 1, in order to make walking more comfortable and to make the sole grip better.

A boot of this type can be manufactured using a variety of methods.

In the embodiments which are represented in the following figures, the rigid part 1 of the sole is preferably made of plastic and is formed integrally, by injection molding, with a part 5 that forms the rear of the upper around and above the heel and extends obliquely as far as the front end of the rigid part 1 of the sole, as represented in FIGS. 3, 5, 7, 9, 11, 13 and 15.

In the example which is represented in FIG. 3, the rigid part 1 of the sole has a bearing surface 6 at the front, to the front of which a recess 20 is formed in the sole 2, and a bearing surface 7 at the rear, these bearing surfaces being intended for binding the part 1 between a front ski binding element and a rear ski binding element. The length d1 of the rigid part 1 could be a unique length standard for all boot sizes, which would make it easier to mount the binding elements and would eliminate the need for adjustments.

The cutout or profiled part 7 presents a bearing surface to accommodate a particular type of rear binding. For the use of conventional types of heel pieces, the rigid part 1 will have a conventional protruding rear bearing surface 8, as represented in FIG. 5.

The rigid part 1 of the sole may have other ski binding means intended to engage with a ski or skate binding. In the embodiment which is represented in FIGS. 7 and 8, these binding means consist of two pairs of lateral pins 9 and 10 which are intended to engage in the notches of a binding and are capable of being locked in these notches. These binding means may also be standardized.

Figure 9:
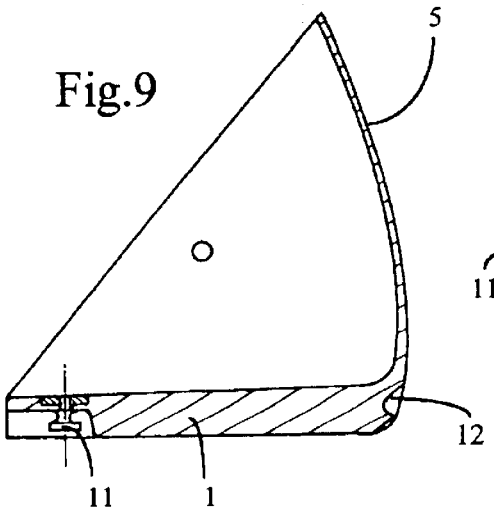
FIGS. 9 and 10 are, respectively, a view in vertical axial section and a bottom view of a fourth embodiment of the rigid part.
Figure 10:
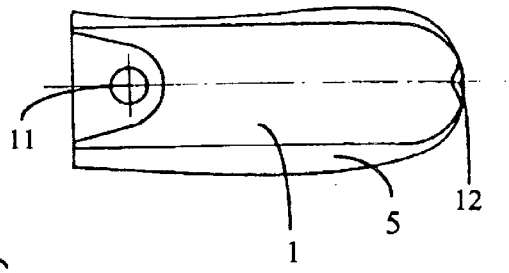

In the embodiment which is represented in FIGS. 9 and 10, the binding means are formed, in the front region of the rigid part 1, by a profiled vertical pin in the shape of a button 11, set back in a hollow of the part 1 and, at the rear, of an indentation 12 intended to accommodate a longitudinal finger of the binding.

Figure 11:
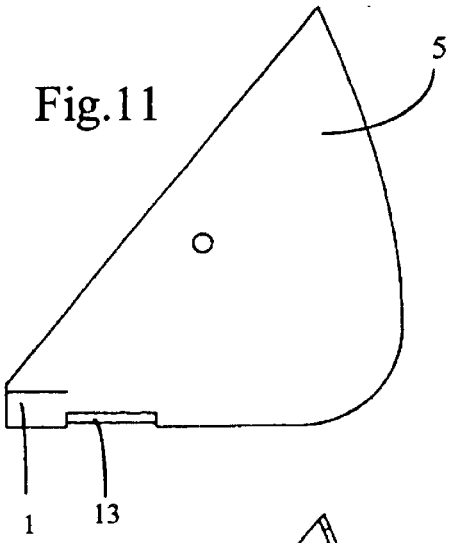
FIGS. 11 and 12 are, respectively, a side and bottom view of a fifth embodiment of the rigid part.
Figure 12:
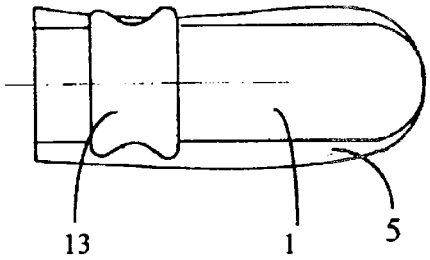

In the embodiment which is represented in FIGS. 11 and 12, the binding means is a profiled part 13 located in a zone of the sole lying under the arch of the foot. This profiled part 13 extends over a short length of the rigid part 1 and by itself binds the boot to the ski, or skate, respectively.

Figure 13:
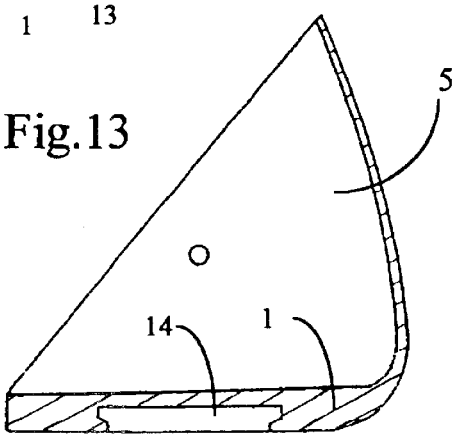
FIGS. 13 an 14 are, respectively, a view in vertical axial section and a bottom view of a sixth embodiment of the rigid part.
Figure 14:
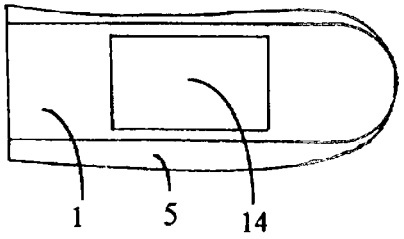
Figure 15:
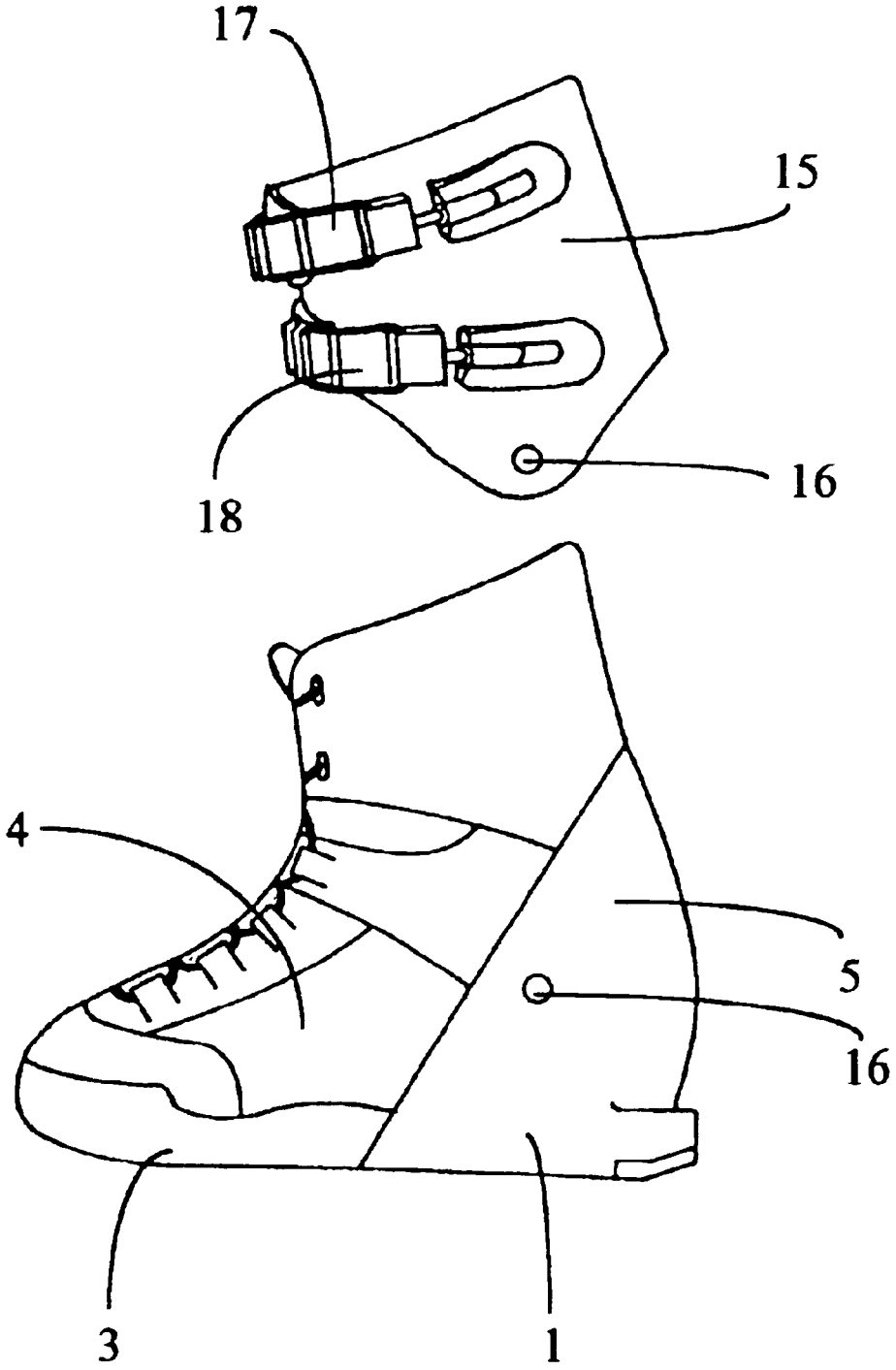
FIG. 15 represents an exploded view of a boot according to the invention, when provided with a cuff.

In the embodiment which is represented in FIGS. 13 and 14, the binding means forming part of the boot consist of a cutout or hollow imprint 14 under the sole, this imprint having, in longitudinal section according to FIG. 13, a T-shaped or dovetail profile in which expandable grippers of the ski or skate binding attach. In all the embodiments which have been described, the binding means are centered on the tibial axis.

The rigid part 5 is advantageously supplemented by a lower-leg cuff 15 articulated to the rigid part 5 at two opposite points 16 lying in the malleolar region. The cuff 15 which is represented in FIG. 5 is a conventional cuff provided with two buckles 17 and 18 for closing and tightening it.

The rigid part 5 could be cut out or openworked, for example by a cutout extending over the rear and over the sides halfway up the part 5.

The rigid part 5 could have at least one diagonal tab extending obliquely forward, for example in the direction of the instep, serving as a strap or part of a strap and capable of supporting a buckle or other means for closing and tightening.

What is claimed is:

1. A boot for a ski or in-line roller skate, the boot having a sole with a heel portion and a front portion, the sole being connected to a flexible upper, wherein the sole has a first rigid part which extends forward from said heel portion over about one half of the length of the sole, wherein the sole has a flexible portion which extends from the front portion rearward to the first rigid part so as to allow the foot to flex during walking, wherein the first rigid part includes an interlocking surface means which interlocks with a binding of an alpine ski or in-line roller skate thus firmly fixing the first rigid part against flexing with respect to the flexible portion; and wherein a second rigid part extends upward from said first rigid part and endcloses a heel of the wearer.

2. The ski boot as claimed in claim 1, wherein the interlocking surface means allows for an automatic release binding to be coupled therewith.

3. The boot as claimed in claim 1, wherein the interlocking surface means has at least one cutout which engages the alpine ski or skate binding.

4. The boot as claimed in claim 1, wherein the interlocking surface means has a profiled part of standard length which engages a ski or skate binding irrespective of the boot size.

5. The boot as claimed in claim 1, wherein the first rigid part comprises at least part of the interlocking surface.

* * * * *